US007538739B2

(12) United States Patent
Tao

(10) Patent No.: US 7,538,739 B2
(45) Date of Patent: May 26, 2009

(54) FLAT ANTENNA

(75) Inventor: Wen-Szu Tao, Hsinchu (TW)

(73) Assignee: Arcadyan Technology Corporation, Hsinchu (TW)

( * ) Notice: Subject to any disclaimer, the term of this patent is extended or adjusted under 35 U.S.C. 154(b) by 440 days.

(21) Appl. No.: 11/517,291

(22) Filed: Sep. 8, 2006

(65) Prior Publication Data

US 2008/0055179 A1 Mar. 6, 2008

(51) Int. Cl.
*H01Q 1/38* (2006.01)
*H01Q 9/28* (2006.01)

(52) U.S. Cl. ..... 343/795; 343/792; 343/812

(58) Field of Classification Search ..... 343/700 MS, 343/792, 793, 795, 812, 813
See application file for complete search history.

(56) References Cited

U.S. PATENT DOCUMENTS 6,747,605 B2 * 6/2004 Lebaric et al. ..... 343/795
6,765,539 B1 * 7/2004 Wang et al. ..... 343/795
6,859,176 B2 * 2/2005 Choi ..... 343/700 MS
6,882,324 B1 * 4/2005 Chen ..... 343/790
7,064,729 B2 * 6/2006 Olson ..... 343/795

* cited by examiner

*Primary Examiner*—Michael C Wimer
(74) *Attorney, Agent, or Firm*—Birch, Stewart, Kolasch & Birch, LLP

(57) ABSTRACT

A flat antenna includes a substrate, a first antenna module having a first grounding unit, a first radiating unit, a first feeding unit and a second radiating unit, and a second antenna module having a second grounding unit, a third radiating unit, a second feeding unit and a fourth radiating unit. The second antenna module is disposed abreast with the first antenna module. The first and the second grounding units, and the first and the third radiating units are disposed on a first surface of the substrate. The first and the second feeding units, and the second and the fourth radiating units are disposed on a second surface of the substrate. The first, the second, the third and the fourth radiating units, which have a first, a second, a third and a forth openings respectively, are electrically connected with the first grounding unit, the first feeding unit, the second grounding unit and the second feeding unit.

19 Claims, 9 Drawing Sheets

Frequency : 1890 MHz
Peak Gain : 3.31dBi (@132°)
Average : 0.77dBi

Frequency : 2450 MHz
Peak Gain : 3.77dBi (@231°)
Average : 0.39dBi

FLAT ANTENNA

BACKGROUND OF THE INVENTION

1. Field of Invention

The invention relates to an antenna, and, in particular, to a flat antenna.

2. Related Art

The rapidly developed radio transmission has brought various products and technologies applied in the field of multi-band transmission, such that many new products have the performance of radio transmission to meet the consumer's requirement. The antenna is an important element for transmitting and receiving electromagnetic wave energy in the radio transmission system. If the antenna is lost, the radio transmission system cannot transmit and receive data. Thus, the antenna plays an indispensable role in the radio transmission system.

In a wireless transmission system, the currently used frequency band specifications include the IEEE 802.11 WLAN (Wireless Local Area Network) and the DECT (Digital Enhanced Cordless Telecommunication) standard. IEEE 802.11 is further divided into the specifications of IEEE 802.11a, IEEE 802.11b and IEEE 802.11g. IEEE 802.11a is the specification corresponding to the frequency band of 5 GHz. IEEE 802.11b and IEEE 802.11g are the specifications corresponding to the frequency band of 2.4 GHz. The DECT standard is the specification corresponding to the frequency band of 1.88 GHz to 1.9 GHz.

To meet the above-mentioned specifications, a flat antenna is frequently used. Referring to FIG. 1, the conventional wireless network device includes a host H1 and two flat antennas 1 and 1', which are disposed on the host H1 and respectively disposed in casings C1 and C1'. The flat antennas 1 and 1' have the same specification and operate in the frequency band satisfying the WLAN specification to prevent the single antenna from missing out a portion of a wireless signal when receiving the wireless signal. Thus, the frequently used solution is to use two antennas for the spatial compensation to reduce the missing of the wireless signal.

Similarly, as shown in FIG. 2, a conventional DECT device includes a host H2 and two flat antennas 2 and 2', which are disposed on the host H2 and respectively disposed in casings C2 and C2'. The flat antennas 2 and 2' have the same specification and operate in the frequency band satisfying the DECT standard specification. In order to make the signal transmission for the DECT have the spatial compensation effect, two sets of antennas have to be used.

As shown in FIG. 3, if the wireless communication device must have the transmission functions of the WLAN and the DECT, the four flat antennas 1, 1', 2 and 2' have to be disposed on a host H3. In other words, the manufacturer has to manufacture the four flat antennas 1, 1', 2 and 2' respectively and the manufacturing cost is increased. The flat antennas 1, 1', 2 and 2' are assembled on the host H3, and the space is occupied and the too many antennas also influence the glory of the product.

Thus, it is an important subject of the invention to provide a flat antenna, which integrates the transmission functions of the WLAN and the DECT together so as to reduce the number of flat antennas of the communication device.

SUMMARY OF THE INVENTION

In view of the foregoing, the invention is to provide a flat antenna of integrating transmission functions of a WLAN and a DECT together so as to reduce the number of flat antennas required in the communication device.

To achieve the above, the invention discloses a flat antenna including a substrate, a first antenna module and a second antenna module. The substrate has a first surface and a second surface opposite to each other. The first antenna module has a first grounding unit, a first radiating unit, a first feeding unit and a second radiating unit. The second antenna module is disposed abreast with the first antenna module and has a second grounding unit, a third radiating unit, a second feeding unit and a fourth radiating unit.

The first grounding unit is disposed on the first surface of the substrate. The first radiating unit has a first opening and is disposed on the first surface of the substrate. The first radiating unit is electrically connected with the first grounding unit. The first feeding unit is disposed on the second surface of the substrate. The second radiating unit has a second opening disposed opposite to the first opening and is disposed on the second surface of the substrate. The second radiating unit is electrically connected with the first feeding unit.

The second grounding unit is disposed on the first surface of the substrate. The third radiating unit has a third opening and is disposed on the first surface of the substrate. The third radiating unit is electrically connected with the second grounding unit. The second feeding unit is disposed on the second surface of the substrate. The fourth radiating unit has a fourth opening disposed opposite to the third opening and is disposed on the second surface of the substrate. The fourth radiating unit is electrically connected with the second feeding unit.

As mentioned above, the flat antenna of the invention includes the first antenna module operating at the frequency band of WLAN, and the second antenna module operating at the frequency band of DECT. Thus, the flat antenna of the invention possesses the transmission functions of WLAN and DECT. In other words, when the flat antenna of the invention is applied to the communication device with the transmission functions of WLAN and DECT, the number of flat antennas mounted on the communication device is only one half that of the prior art. Accordingly, not only the manufacturing cost of the communication device but also the space occupied by the flat antenna can be reduced.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 2:
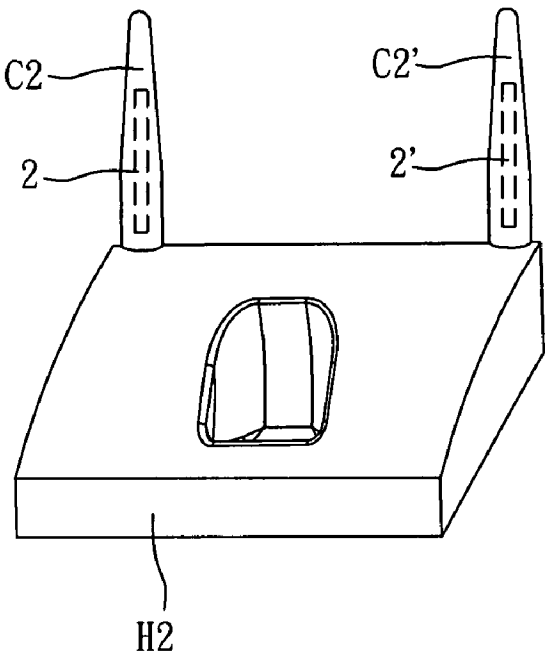
FIG. 2 (PRIOR ART)
FIG. 2 is a schematic illustration showing a conventional DECT device.
Figure 1:
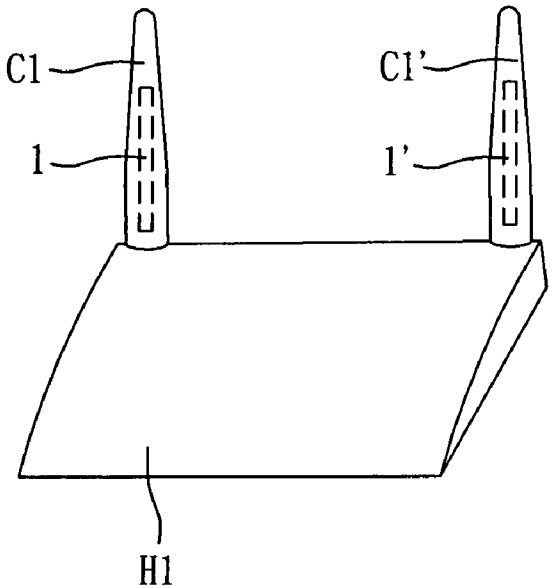
FIG. 1 (PRIOR ART)
FIG. 1 is a schematic illustration showing a conventional wireless network device.
Figure 3:
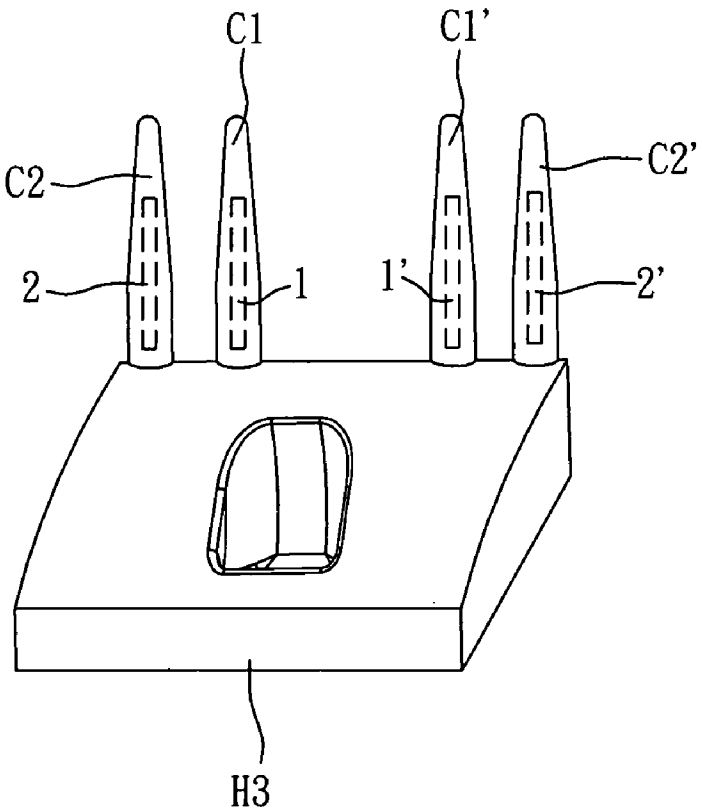
FIG. 3 (PRIOR ART)
FIG. 3 is a schematic illustration showing a conventional wireless communication device.
Figure 4:
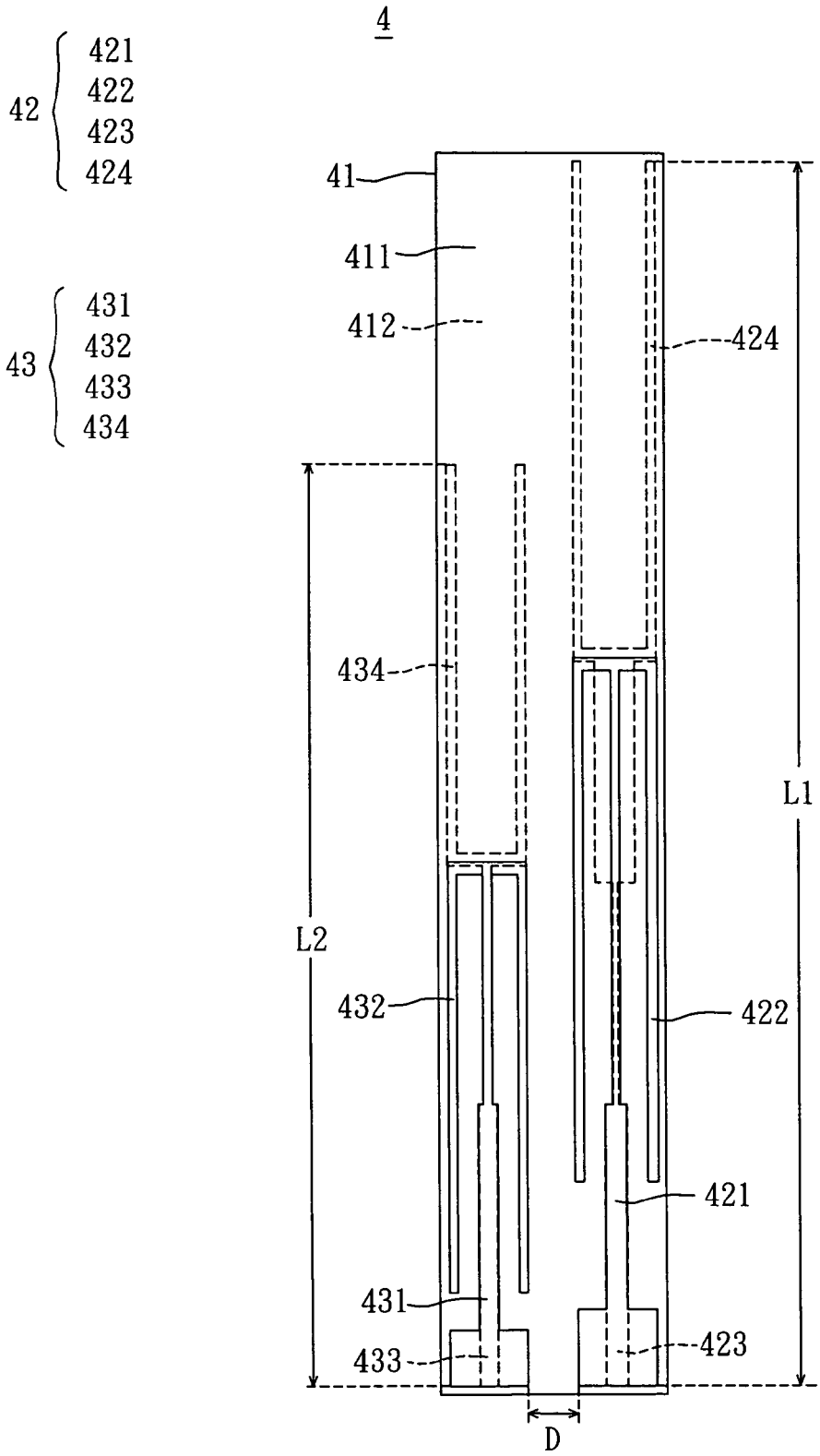
FIG. 4 is a schematic illustration showing a flat antenna according to a preferred embodiment of the invention.

Referring to FIG. 4, a flat antenna 4 according to the preferred embodiment of the invention includes a substrate 41, a first antenna module 42 and a second antenna module 43. In this embodiment, the second antenna module 43 is disposed abreast with the first antenna module 42.

The substrate 41 has a first surface 411 and a second surface 412 opposite to each other. It is to be specified that the first surface 411 of FIG. 4 and the elements disposed on the first surface 411 are represented by solid lines, while the second surface 412 and the elements disposed on the second surface 412 are represented by dashed lines. In this embodiment, the substrate 41 may be a printed circuit board made of a BT (Bismaleimide-triazine) resin or a fiberglass reinforced epoxy resin (FR4). In addition, the substrate 41 may be a flexible film substrate made of polyimide.

The first antenna module 42 has a first grounding unit 421 and a first radiating unit 422 disposed on the first surface 411 of the substrate 41, and a first feeding unit 423 and a second radiating unit 424 disposed on the second surface 412 of the substrate 41. The first radiating unit 422 is electrically connected with the first grounding unit 421. The second radiating unit 424 is electrically connected with the first feeding unit 423. The second antenna module 43 has a second grounding unit 431 and a third radiating unit 432 disposed on the first surface 411 of the substrate 41, and a second feeding unit 433 and a fourth radiating unit 434 disposed on the second surface 412 of the substrate 41. The third radiating unit 432 is electrically connected with the second grounding unit 431, and the fourth radiating unit 434 is electrically connected with the second feeding unit 433.

In this embodiment, the shapes of the first grounding unit 421, the first feeding unit 423, the second grounding unit 431 and the second feeding unit 433 may be differently designed according to the actual condition, such as the impedance matching level, and detailed descriptions thereof will be omitted.

In addition, the distance D between the first antenna module 42 and the second antenna module 43 in this embodiment is greater than or equal to 1 mm, and the length L1 of the first antenna module 42 or the length L2 of the second antenna module 43 is greater than or equal to 60 mm.

Figure 5A:
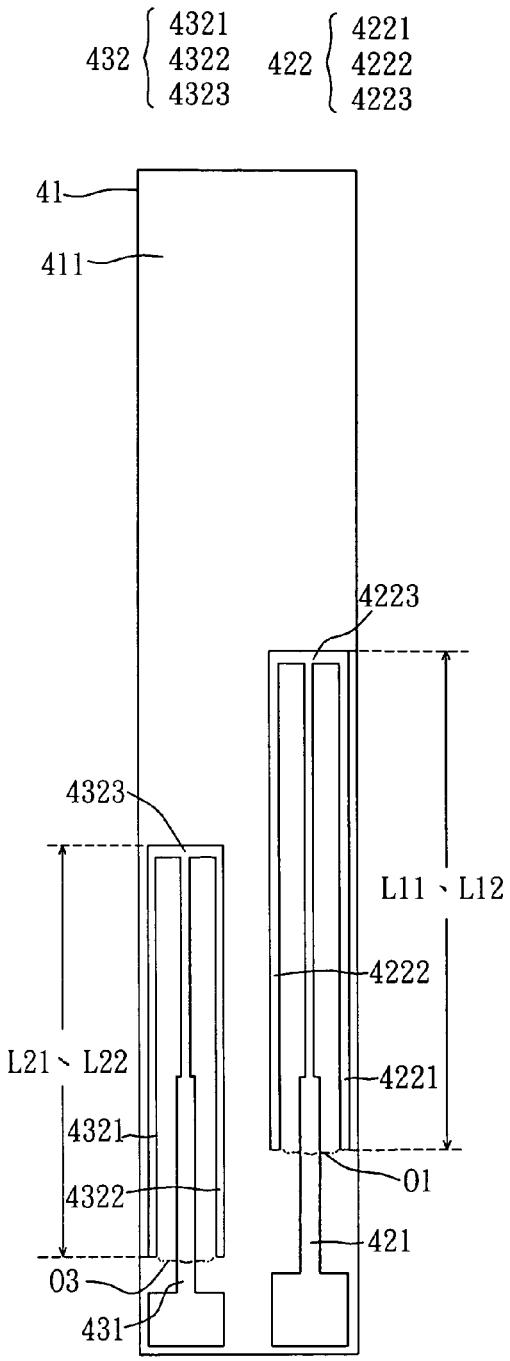
FIGS. 5A and 5B are schematic illustrations respectively showing a first surface side and a second surface side of a substrate of the flat antenna of FIG. 4.
Figure 5B:
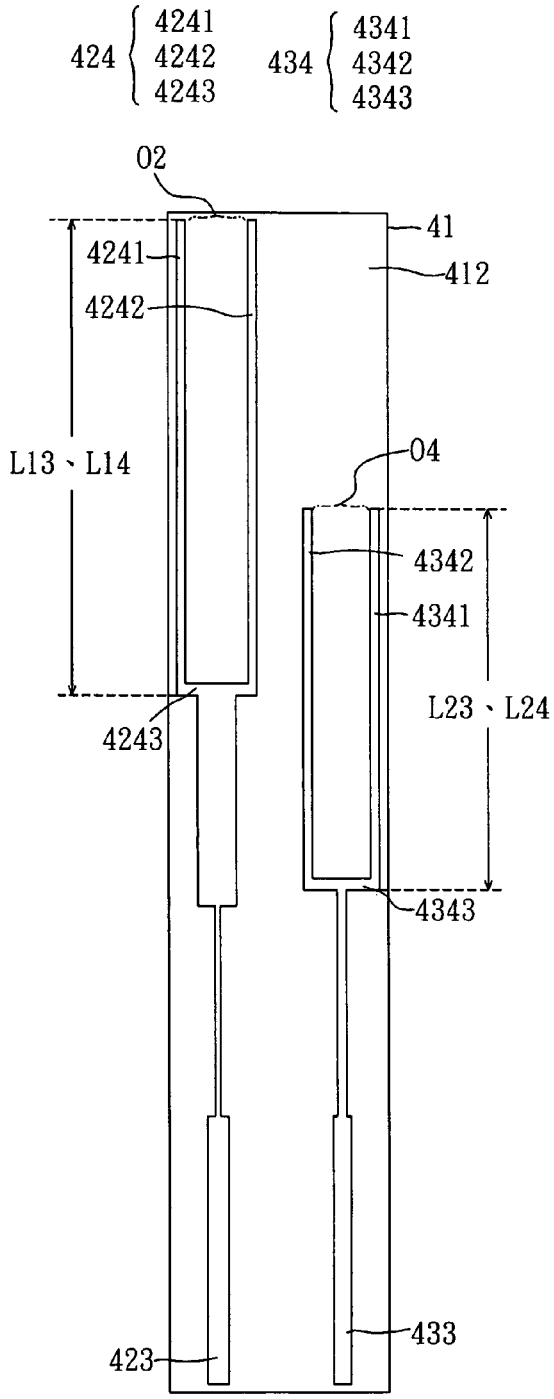

Please refer to FIGS. 5A and 5B, wherein FIG. 5A shows the first surface 411 of the substrate 41 and the elements disposed thereon, and FIG. 5B shows the second surface 412 of the substrate 41 and the elements disposed thereon.

The first radiating unit 422 has a first opening O1 (see FIG. 5A). The second radiating unit 424 has a second opening O2 (see FIG. 5B) disposed opposite to the first opening O1. The third radiating unit 432 has a third opening O3 (see FIG. 5A). The fourth radiating unit 434 has a fourth opening O4 (see FIG. 5B) disposed opposite to the third opening O3. The first to fourth openings O1 to O4 of the first to fourth radiating units 422, 424, 432 and 434 may have different shapes including, for example, a horseshoe shape, a semi-circular shape and a concave shape.

The first radiating unit 422 of the flat antenna 4 further includes a first radiating portion 4221, a second radiating portion 4222 and a first electrical connection portion 4223. The first radiating portion 4221 is disposed opposite to the second radiating portion 4222. The first electrical connection portion 4223 is electrically connected with the first radiating portion 4221 and the second radiating portion 4222 to form the first opening O1. The first grounding unit 421 is electrically connected with the first electrical connection portion 4223, as shown in FIG. 5A.

The second radiating unit 424 of the flat antenna 4 further includes a third radiating portion 4241, a fourth radiating portion 4242 and a second electrical connection portion 4243. The third radiating portion 4241 is disposed opposite to the fourth radiating portion 4242. The second electrical connection portion 4243 is electrically connected with the third radiating portion 4241 and the fourth radiating portion 4242 to form the second opening O2. The first feeding unit 423 is electrically connected with the second electrical connection portion 4243, as shown in FIG. 5B.

In this embodiment, the first electrical connection portion 4223 is disposed on a projection position of the second electrical connection portion 4243. That is, the first electrical connection portion 4223 and the second electrical connection portion 4243 at least partially overlap with each other, and are respectively disposed on the first surface 411 and the second surface 412 of the substrate 41.

In addition, the length L11 of the first radiating portion 4221, the length L12 of the second radiating portion 4222, the length L13 of the third radiating portion 4241 and the length L14 of the fourth radiating portion 4242 range from 25 mm to 40 mm. In this embodiment, the length L11 of the first radiating portion 4221 is equal to the length L12 of the second radiating portion 4222, while the length L13 of the third radiating portion 4241 is equal to the length L14 of the fourth radiating portion 4242.

Similarly, the third radiating unit 432 of the flat antenna 4 further includes a fifth radiating portion 4321, a sixth radiating portion 4322 and a third electrical connection portion 4323. The fifth radiating portion 4321 is disposed opposite to the sixth radiating portion 4322. The third electrical connection portion 4323 is electrically connected with the fifth radiating portion 4321 and the sixth radiating portion 4322 to form the third opening O3. The second grounding unit 431 is electrically connected with the third electrical connection portion 4323, as shown in FIG. 5A.

The fourth radiating unit 434 of the flat antenna 4 further includes a seventh radiating portion 4341, an eighth radiating portion 4342 and a fourth electrical connection portion 4343. The seventh radiating portion 4341 is disposed opposite to the eighth radiating portion 4342. The fourth electrical connection portion 4343 is electrically connected with the seventh radiating portion 4341 and the eighth radiating portion 4342 to form the fourth opening O4. The second feeding unit 433 is electrically connected with the fourth electrical connection portion 4343, as shown in FIG. 5B.

In this embodiment, the fourth electrical connection portion 4343 is disposed on a projection position of the third electrical connection portion 4323. That is, the fourth electrical connection portion 4343 and the third electrical connection portion 4323 at least partially overlap with each other and are respectively disposed on the second surface 412 and the first surface 411 of the substrate 41.

In addition, the length L21 of the fifth radiating portion 4321, the length L22 of the sixth radiating portion 4322, the length L23 of the seventh radiating portion 4341 and the length L24 of the eighth radiating portion 4342 range from 17 mm to 30 mm. In this embodiment, the length L21 of the fifth radiating portion 4321 is equal to the length L22 of the sixth radiating portion 4322, while the length L23 of the seventh radiating portion 4341 is equal to the length L24 of the eighth radiating portion 4342.

In this embodiment, the first antenna module 42 operates in the frequency band of the WLAN (Wireless Local Area Network), and the second antenna module 43 operates in the frequency band of DECT (Digital Enhanced Cordless Telecommunication).

Figure 6:
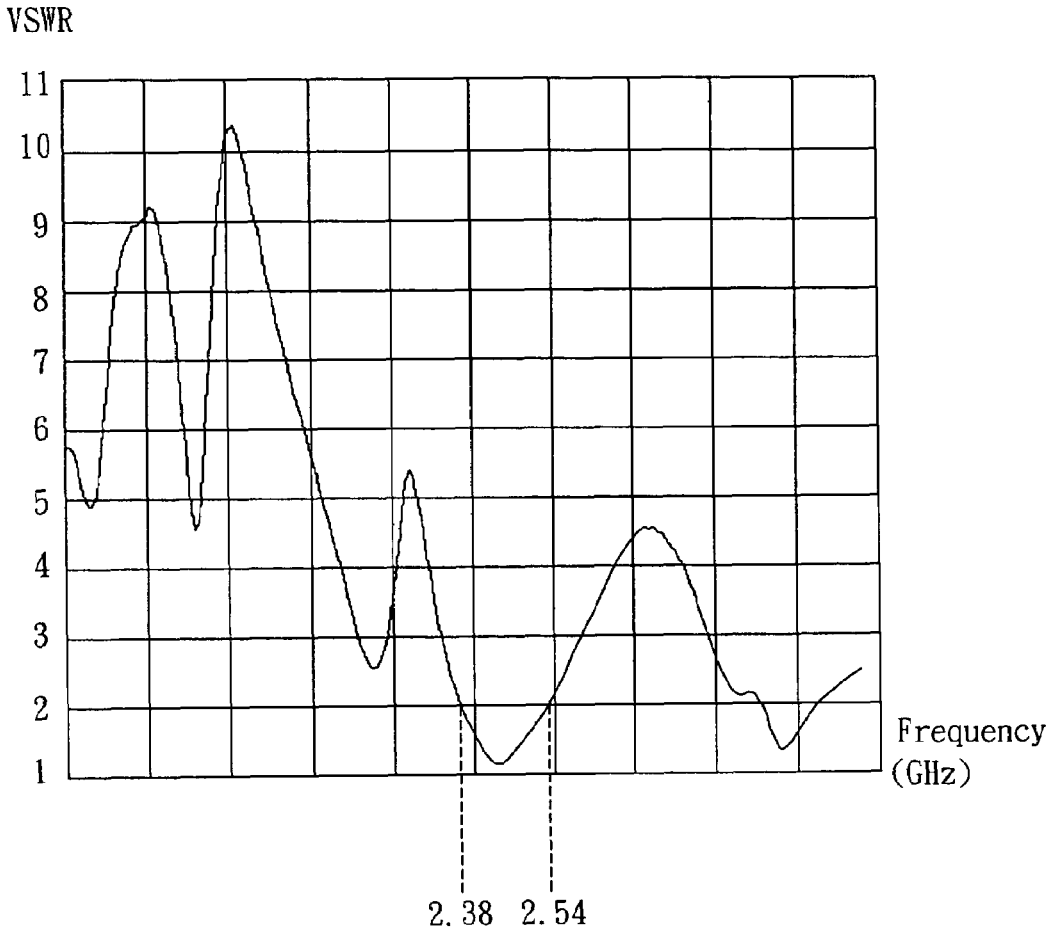
FIGS. 6 and 7 show measured results of VSWRs of the flat antenna according to the preferred embodiment of the invention.
Figure 7:
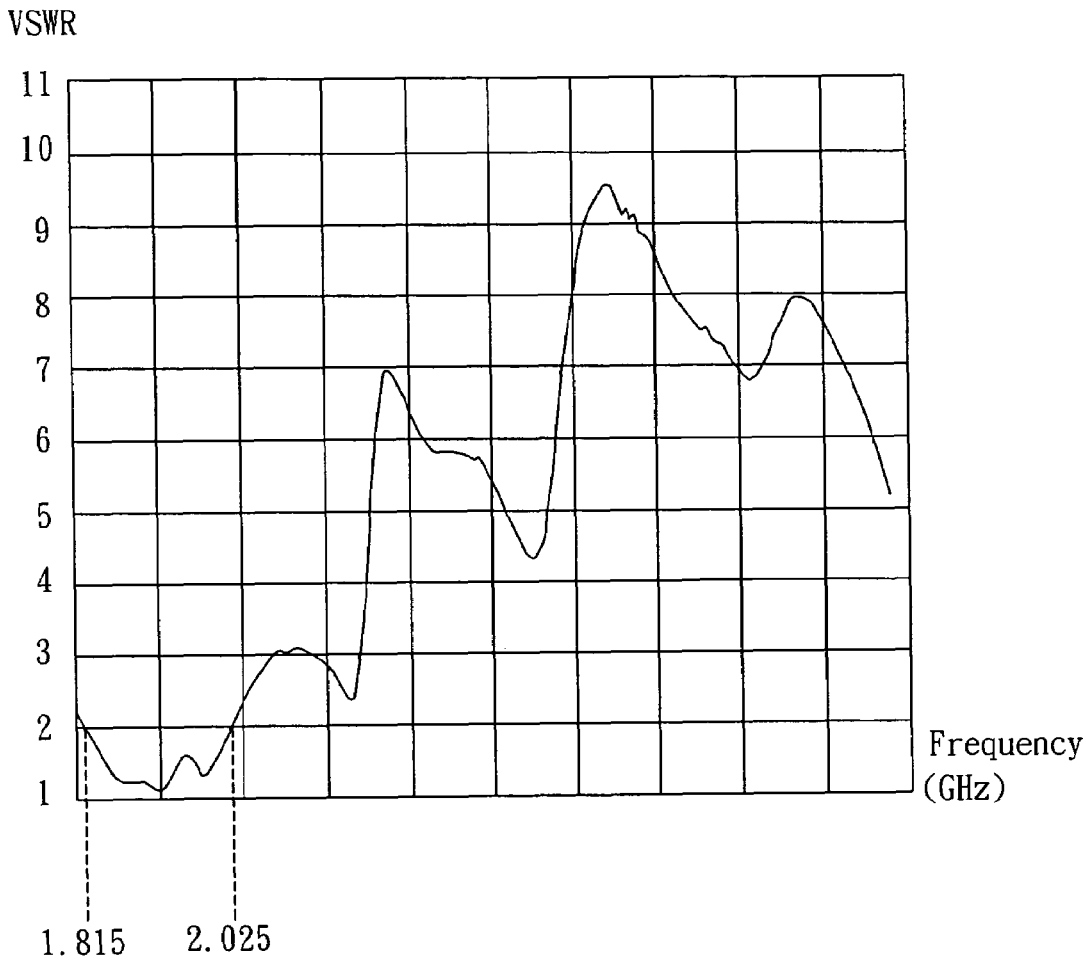

Referring to FIGS. 6 and 7, the vertical axis represents the VSWR (Voltage Standing Wave Ratio) and the horizontal axis represents the frequency. It is observed that the flat antenna according to the preferred embodiment of the invention can operate in the frequency bands respectively ranging from about 2.38 to 2.54 GHz and 1.815 to 2.025 GHz according to the acceptable definition of the VSWR smaller than 2. In other words, the flat antenna 4 of the invention can operate in the frequency bands of WLAN and DECT.

Figure 8:
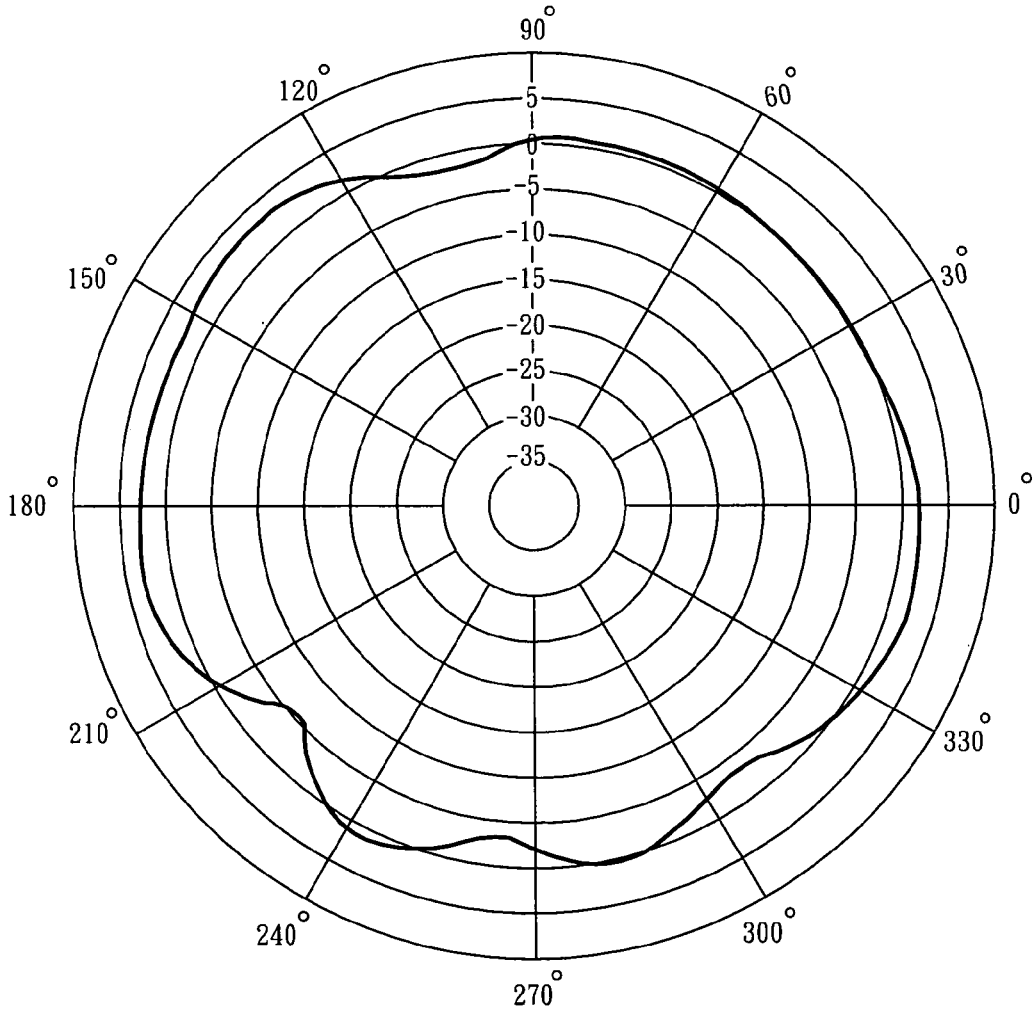
FIGS. 8 and 9 show measured results of radiation patterns of H-Plane when the flat antenna of the embodiment of the invention operates at 1.89 GHz and 2.45 GHz.
Figure 9:
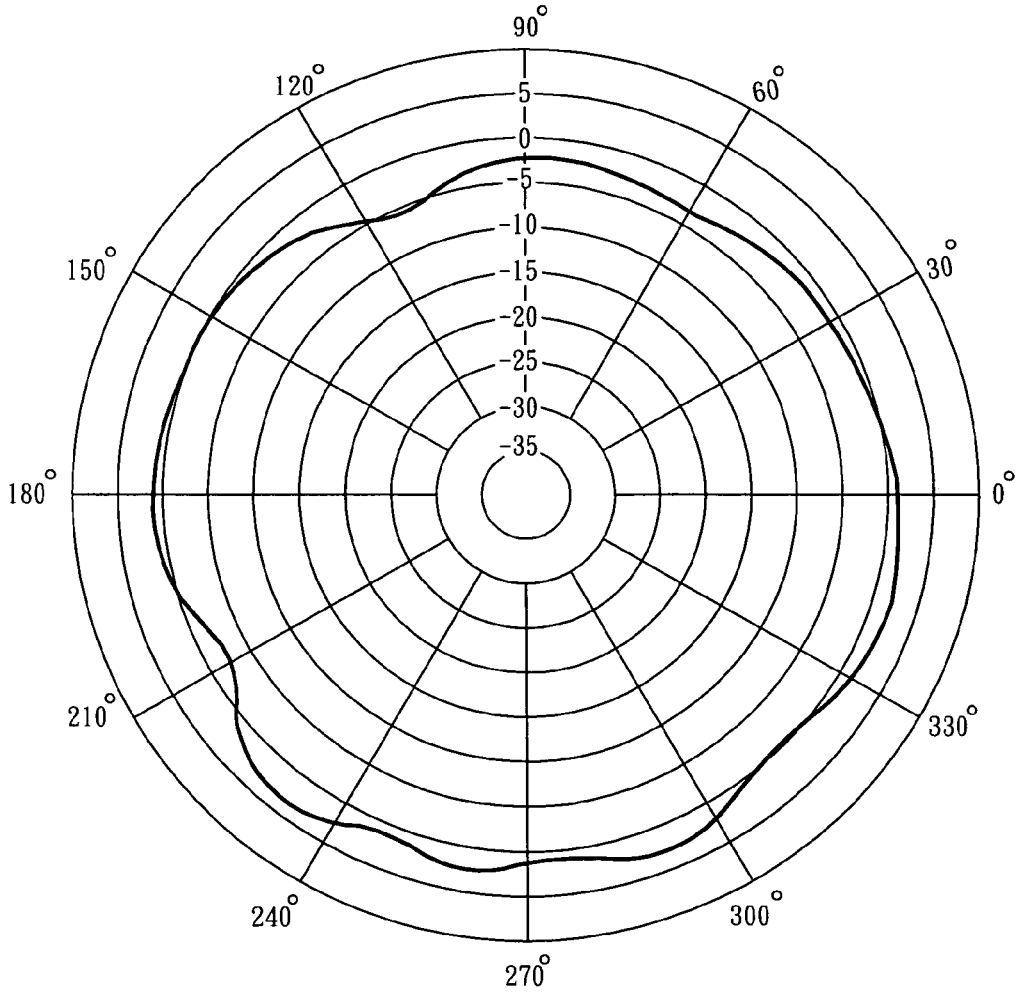

FIGS. 8 and 9 show measured results of radiation patterns of H-Plane when the flat antenna 4 of the embodiment of the invention operates at 1.89 GHz and 2.45 GHz. When the flat antenna 4 operates at 1.89 GHz with the angle of 132 degrees, the peak gain is about 3.31 dBi. When the flat antenna 4 operates at 2.45 GHz with the angle of 231 degrees, the peak gain is about 3.77 dBi.

Figure 10:
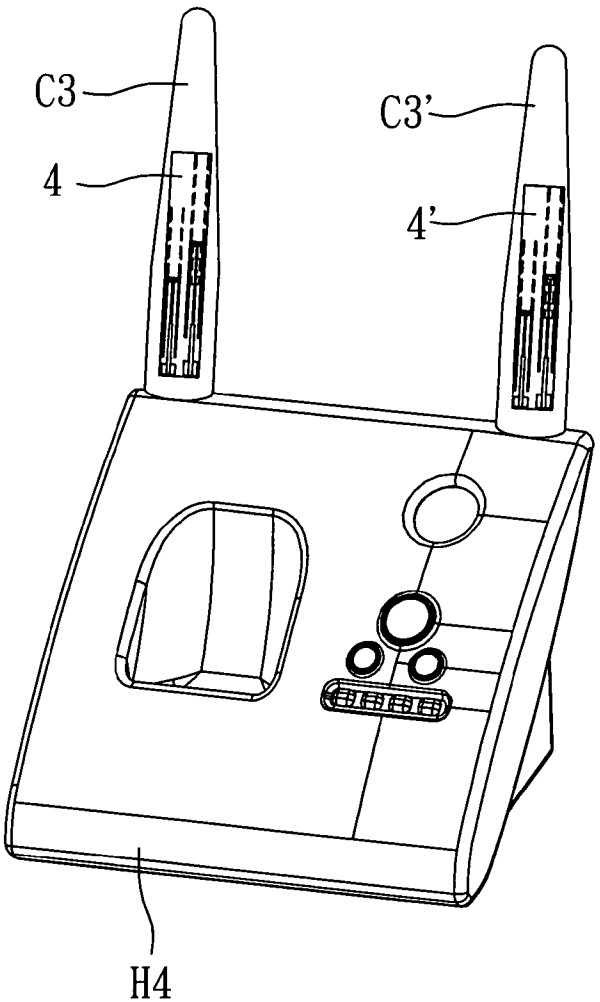
FIG. 10 is a schematic illustration showing a wireless communication device having the flat antenna according to the preferred embodiment of the invention.

Referring again to FIG. 10, when a wireless communication device has to possess the transmission functions of WLAN and DECT, only two flat antennas 4 and 4' for spatial compensation have to be disposed on a host H4, and the flat antennas 4 and 4' are respectively disposed on casings C3 and C3'. Therefore, the two antennas make the wireless communication device have the transmission functions of WLAN and DECT.

In summary, the flat antenna of the invention includes the first antenna module operating at the frequency band of WLAN, and the second antenna module operating at the frequency band of DECT. Thus, the flat antenna of the invention possesses the transmission functions of WLAN and DECT. In other words, when the flat antenna of the invention is applied to the communication device with the transmission functions of WLAN and DECT, the number of flat antennas mounted on the communication device is only one half that of the prior art. Accordingly, not only the manufacturing cost of the communication device but also the space occupied by the flat antenna can be reduced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A flat antenna, comprising:

a substrate having a first surface and a second surface opposite to each other;

a first antenna module having a first grounding unit, a first radiating unit, a first feeding unit and a second radiating unit, wherein the first grounding unit is disposed on the first surface of the substrate, the first radiating unit has a first opening and is disposed on the first surface of the substrate, the first radiating unit is electrically connected with the first grounding unit, the first feeding unit is disposed on the second surface of the substrate, the second radiating unit has a second opening disposed opposite to the first opening and is disposed on the second surface of the substrate, and the second radiating unit is electrically connected with the first feeding unit; and a second antenna module disposed abreast with the first antenna module and having a second grounding unit, a third radiating unit, a second feeding unit and a fourth radiating unit, wherein the second grounding unit is disposed on the first surface of the substrate, the third radiating unit has a third opening and is disposed on the first surface of the substrate, the third radiating unit is electrically connected with the second grounding unit, the second feeding unit is disposed on the second surface of the substrate, the fourth radiating unit has a fourth opening disposed opposite to the third opening and is disposed on the second surface of the substrate, and the fourth radiating unit is electrically connected with the second feeding unit.

2. The flat antenna according to claim 1, wherein a distance between the first antenna module and the second antenna module is greater than or equal to 1 mm.

3. The flat antenna according to claim 1, wherein a length of each of the first antenna module and the second antenna module is greater than or equal to 60 mm.

4. The flat antenna according to claim 1, wherein the first radiating unit further comprises a first radiating portion, a second radiating portion and a first electrical connection portion, the first radiating portion is disposed opposite to the second radiating portion, and the first electrical connection portion is electrically connected with the first radiating portion and the second radiating portion to form the first opening.

5. The flat antenna according to claim 4, wherein the first grounding unit is electrically connected with the first electrical connection portion.

6. The flat antenna according to claim 4, wherein the second radiating unit further comprises a third radiating portion, a fourth radiating portion and a second electrical connection portion, the third radiating portion is disposed opposite to the fourth radiating portion, the second electrical connection portion is electrically connected with the third radiating portion and the fourth radiating portion to form the second opening.

7. The flat antenna according to claim 6, wherein the first feeding unit is electrically connected with the second electrical connection portion.

8. The flat antenna according to claim 6, wherein the first electrical connection portion is disposed on a projection position of the second electrical connection portion.

9. The flat antenna according to claim 6, wherein a length of each of the first radiating portion, the second radiating portion, the third radiating portion and the fourth radiating portion ranges from 25 mm to 40 mm.

10. The flat antenna according to claim 1, wherein the third radiating unit further comprises a fifth radiating portion, a sixth radiating portion and a third electrical connection portion, the fifth radiating portion is disposed opposite to the sixth radiating portion, and the third electrical connection portion is electrically connected with the fifth radiating portion and the sixth radiating portion to form the third opening.

11. The flat antenna according to claim 10, wherein the second grounding unit is electrically connected with the third electrical connection portion.

12. The flat antenna according to claim 10, wherein the fourth radiating unit further comprises a seventh radiating portion, a eighth radiating portion and a fourth electrical connection portion, the seventh radiating portion is disposed opposite to the eighth radiating portion, and the fourth electrical connection portion is electrically connected with the seventh radiating portion and the eighth radiating portion to form the fourth opening.

13. The flat antenna according to claim 12, wherein the second feeding unit is electrically connected with the fourth electrical connection portion.

14. The flat antenna according to claim 12, wherein the fourth electrical connection portion is disposed on a projection position of the third electrical connection portion.

15. The flat antenna according to claim 12, wherein a length of each of the fifth radiating portion, the sixth radiating portion, the seventh radiating portion and the eighth radiating portion ranges from 17 mm to 30 mm.

16. The flat antenna according to claim 1, wherein the first antenna module operates in a frequency band for a WLAN (Wireless Local Area Network).

17. The flat antenna according to claim 16, wherein the frequency band for the WLAN comprises 802.11a, 802.11b, and 802.11g.

18. The flat antenna according to claim 1, wherein the second antenna module operates in a frequency band for a DECT (Digital Enhanced Cordless Telecommunication).

19. The flat antenna according to claim 18, wherein the frequency band for the DECT ranges from 1.88 GHz to 1.9 GHz.

* * * * *